US007994110B2

(12) United States Patent
Wenk et al.

(10) Patent No.: US 7,994,110 B2
(45) Date of Patent: Aug. 9, 2011

(54) SOLID REDISPERSIBLE EMULSION

(75) Inventors: Hans Wenk, Essen (DE); Georg Schick, Chester, VA (US); Kathrin John, Hamburg (DE)

(73) Assignee: Evonik Degussa GmbH, Essen (DE)

( * ) Notice: Subject to any disclaimer, the term of this patent is extended or adjusted under 35 U.S.C. 154(b) by 461 days.

(21) Appl. No.: 11/919,701

(22) PCT Filed: May 3, 2006

(86) PCT No.: PCT/EP2006/062019

§ 371 (c)(1),
(2), (4) Date: Nov. 27, 2008

(87) PCT Pub. No.: WO2006/117385

PCT Pub. Date: Nov. 9, 2006

(65) Prior Publication Data

US 2009/0105110 A1 Apr. 23, 2009

(30) Foreign Application Priority Data

May 3, 2005 (DE) ..... 10 2005 020 551

(51) Int. Cl.
*C11D 17/04* (2006.01)

(52) U.S. Cl. ..... 510/441

(58) Field of Classification Search ..... 510/441
See application file for complete search history.

(56) References Cited

U.S. PATENT DOCUMENTS

| | | | | |
|---|---|---|---|---|
| 2,464,081 | A | 3/1949 | Hansen et al. | |
| 4,154,695 | A | 5/1979 | McCrudden | |
| 4,389,419 | A | 6/1983 | Lim | |
| 4,515,928 | A | 5/1985 | Schwarz | |
| 4,690,682 | A * | 9/1987 | Lim | 424/497 |
| 4,758,282 | A | 7/1988 | Stober | |
| 4,785,087 | A | 11/1988 | Stober et al. | |
| 4,908,233 | A | 3/1990 | Takizawa et al. | |
| 4,968,500 | A | 11/1990 | Bertsch-Frank | |
| 5,094,827 | A | 3/1992 | Bertsch-Frank | |
| 5,378,826 | A | 1/1995 | Hoppe et al. | |
| 5,710,115 | A | 1/1998 | Patel | |
| 5,763,378 | A | 6/1998 | Painter | |
| 6,036,887 | A | 3/2000 | Guerin et al. | |
| 6,602,837 | B1 | 8/2003 | Patel | |
| 6,740,631 | B2 | 5/2004 | Sheffer et al. | |
| 6,825,161 | B2 | 11/2004 | Sheffer et al. | |
| 2003/0087788 | A1 | 5/2003 | Guerin et al. | |
| 2003/0195133 | A1 | 10/2003 | Sheffer et al. | |
| 2004/0029760 | A1 | 2/2004 | Meli et al. | |
| 2004/0191366 | A1 | 9/2004 | Mangos | |
| 2005/0054848 | A1 | 3/2005 | Valta et al. | |
| 2009/0088565 | A1 | 4/2009 | Schick et al. | |

FOREIGN PATENT DOCUMENTS

| | | | |
|---|---|---|---|
| DE | 1 063 506 | | 8/1959 |
| DE | 1917738 | | 10/1970 |
| DE | 43 19 915 | A1 | 12/1994 |
| DE | 43 44 156 | A1 | 6/1995 |
| DE | 197 40 645 | A1 | 3/1999 |
| DE | 101 00 689 | A1 | 7/2002 |
| DE | 101 64 110 | A1 | 7/2003 |
| GB | 911 483 | | 11/1962 |
| GB | 1 310 715 | | 3/1973 |
| GB | 1 390 503 | | 4/1975 |
| RU | 2 106 368 | C1 | 3/1998 |
| WO | WO 93/07086 | | 4/1993 |
| WO | WO 96/12003 | | 4/1996 |
| WO | WO 97/18289 | | 5/1997 |
| WO | WO 98/11189 | | 3/1998 |
| WO | WO 00/27990 | | 5/2000 |
| WO | WO 03/064476 | A1 | 8/2003 |
| WO | WO 2004/080440 | A1 | 9/2004 |

OTHER PUBLICATIONS

English translation of Written Opinion of the International Searching Authority for PCT/EP2006/062019.
English language Translation for DE 1 063 506.
English language abstract for DE 43 19 915 A1.
English language abstract for DE 43 44 156 A1.
English language abstract for RU 2 106 368 C1.
German Search Report for related application 10 2005 020 551.8.
English language abstract for DE 197 40 645 A1.
English language abstract for DE 101 00 689 A1.
International Search Report for PCT/EP2006/062019.
Written Opinion of the International Searching Authority for PCT/EP2006/062019.
English language translation of the International Preliminary Report on Patentability for PCT/EP2006/062019 filed May 3, 2006.
Machine translation of DE 4329915 Al (1994).
Srivastava, et al., *Seed Galactomannans: An Overview, Chemistry & Biodiversity* 2:295-317 (2005).
Office Action mailed Jun. 9, 2011 for copending U.S. Appl. No. 11/919,702.

* cited by examiner

*Primary Examiner* — John R Hardee
(74) *Attorney, Agent, or Firm* — Law Office of Michael A. Sanzo, LLC

(57) ABSTRACT

The invention relates to a solid redispersible emulsion, which is comprised of an oil-in-water emulsion consisting of a laundry care constituent, which is encapsulated in an enclosure. This enclosure is stabilized by polyvalent metal ions and, initially, is water-insoluble and is rendered soluble by adding metal ions. The enclosure material is preferably a biodegradable material and, in particular, a polysaccharide, such as alginates, pectins or carageenans. These solid and redispersible emulsions are used, in particular, in laundry care products.

22 Claims, No Drawings

SOLID REDISPERSIBLE EMULSION

CROSS REFERENCE TO RELATED APPLICATIONS

The present application is U.S. national stage of international application PCT/EP2006/062019, which had an international filing date of May 3, 2006, and which was published in German under PCT Article 21(2) on Nov. 9, 2006. The international application claims priority to German application 10 2005 020 551.8, filed on May 3, 2005. These prior applications are hereby incorporated by reference in their entirety.

The present invention provides a solid redispersible emulsion.

The use of solid redispersible emulsions enables independence from solvents, which implies significant advantages especially from storage and transport technology aspects. However, the stability problems which are otherwise customary and which are frequently very marked in the case of liquid formulations are also avoided by solid formulation alternatives.

For conversion of liquids to a powder form, the prior art provides numerous different methods. The most well known is spray-drying with the aid of suitable carrier materials. However, adsorption on a solid carrier substance or encapsulation with a suitable shell material are also possible.

Both spray-drying and adsorption are, though, not suitable for all problem solutions, since, particularly with emulsions, only a relatively low degree of loading of the carrier material with the emulsion can be achieved and, moreover, the emulsion is frequently unstable in the presence of the carrier material. In addition, emulsion powders prepared by spray-drying or adsorption frequently release some of the oil component even under a moderate force, as occurs, for example, in the course of processing or storage.

Also well known are processes for encapsulating hydrophobic liquids or water-in-oil emulsions. GB 911,483, for example, discloses the encapsulation of emulsions of hydrophilic liquids in oil by coacervation in aqueous solutions. However, such processes are not suitable for encapsulating hydrophilic liquids or oil-in-water emulsions, since the hydrophilic phase would mix with the aqueous encapsulation solution.

Additionally known from the prior art are encapsulation methods with whose aid the encapsulated component can be released in a controlled manner by altering the media surrounding it. In most cases, temperature or pH changes influence the release profile of the encapsulated component. International patent application WO 03/091379 A1 discloses a composition which consists of hydrophobic nanoparticles which are encapsulated in a moisture-sensitive matrix. These nanoparticles may, for example, comprise a fabric softener which is released from the outer matrix on contact with water. However, this process is unsuitable for oil-in-water emulsions of a hydrophobic liquid, since the water-soluble matrix is incompatible with the aqueous phase of such emulsions.

US application U.S. 2004/0029760 A1, which had been published at the priority date of this application, describes a laundry aid in the form of a composition which enables slow and controlled release of the ingredients, for example fragrances. For this purpose, the active component is adsorbed on a porous support material which is subsequently coated with the encapsulation material.

This method is also unsuitable for encapsulating oil-in-water emulsions, since they are not adsorbed by porous materials without coalescence, and a water-soluble encapsulation material as is necessary for the release in the wash liquor is also unsuitable for the encapsulation of water-based systems.

Compositions with controlled release, which consist of nanoparticles of the active component which are in turn enclosed in a pH- or salt-sensitive microcapsule, are described by patent application U.S. 2003/0195133 A1. Like the processes already described, this method is also suitable exclusively for the encapsulation of hydrophobic water-immiscible substances but not of an aqueous emulsion.

To date, no suitable system is known from the prior art with which an oil-in-water emulsion of a hydrophobic liquid, of which one example is fabric softeners, can be converted to a solid form such that, on the one hand, mechanically stable particles can be obtained, but, on the other hand, dissolution with complete restoration of the emulsion proceeds under controlled conditions. Such a system would be particularly advantageous for laundry care compositions, which usually consist of water-insoluble substances and which, for this reason, frequently have to be used to date in the form of liquid emulsions. Prominent examples thereof are fabric softener emulsions, which to date are obtainable exclusively in liquid form. A serious disadvantage in the case of the liquid fabric softeners is considered to be that large proportions of inactive components such as water, alcohols, dispersing aids or stabilizers have to be added to these dosage forms. An additional factor is that the handling of the liquid fabric softeners deviates significantly from classical washing powder, which makes dosage and handling unfavorable overall.

The simple application of the processes known from the prior art for the conversion of liquids to powder form is very difficult in the case of washing aids and especially fabric softeners, since the shell material, on the one hand, has to be soluble in an aqueous system, as typically constituted by wash liquors, in order thus to ensure that the contents of the solid powder form are actually released in the desired amount in the wash cycle. On the other hand, the shell material, though, must not dissolve in the continuous aqueous phase of the oil-in-water emulsion to be encapsulated.

The known deficiencies of the prior art have provided the object of the present invention, that of providing a solid redispersible emulsion consisting of an oil-in-water emulsion component with which it becomes possible to supply laundry care compositions and typically fabric softeners in an administration form which on the one hand dispenses with superfluous inactive components, such as water, dispersing aids and stabilizers, but on the other hand eases the handling of such emulsions, since they, for example, can also be dosed as a powder, like the other washing additives, and, at the same time, contains a maximum proportion of the active substance.

This object has been achieved with a solid, redispersible emulsion consisting of an oil-in-water emulsion component which is encapsulated in a shell stabilized by polyvalent metal ions, which is water-insoluble and which becomes water-soluble through release of the metal ions.

It has been found that, surprisingly, not only has the objective been achieved by providing mechanically stable particles which are insoluble in water, but an administration form has also been obtained whose shell, especially in the customary washing media, dissolves under such conditions that the emulsion of the oil component, in spite of the extremely low water content of the solid particles, is completely restored. In addition, it has been found that a very high loading of the product (up to well above 75%) with the particular active substances can be achieved, which is not only ecologically but also economically extremely advantageous. It has likewise been found to be ecologically positive that shell materials based on biodegradable substances of natural origin can be used, which can further reduce environmental pollution, for example by waste wash liquors.

Proceeding from the prior art known to date, which had great disadvantages especially for the laundry care compositions, the sum of the advantages found was not to be expected in this way.

An especially advantageous solid emulsion according to the present invention has been found to be one in which the emulsion component is a laundry care component and preferably a fabric softener. However, a fiber protection additive, a fragrance, a hair colorant, a hair conditioner or a composition for hair bleaching or styling is also possible.

With regard to the shell material, polysaccharides have been found to be very advantageous, in particular those which have acid groups in free or salt form. Preference is given here especially to alginates or pectins and more preferably alginic acid, sodium alginate, potassium alginate or ammonium alginate, a low-esterification or -amidation pectin, carrageenans or mixtures thereof. However, all water-soluble polymers which react reversibly with polyvalent metal ions with gel formation are suitable in principle.

As already indicated, the inventive solid redispersible emulsion develops its advantages especially when the shell material comprises biodegradable polysaccharides, which is likewise taken account of by the present invention.

A feature essential to the present invention is that the shell of the emulsion component is stabilized by polyvalent metal ions, as a result of which not only the shell but also the entire emulsion is water-insoluble. Suitable polyvalent metal ions envisaged by the present invention are at least one metal ion from the group of $Ca^{2+}$, $Sr^{2+}$, $Ba^{2+}$, $Al^{3+}$, $Cu^{2+}$ and $Zn^{2+}$. These metal ions are initially present in stable form in the shell and are not removed from the shell until in the aqueous medium and in the presence of suitable compounds capable of binding polyvalent metal ions. In the case of wash liquors, this can be done by components which are present in the washing composition. Typically, the components may be water softeners such as zeolites, EDTA and salts thereof, polyphosphates, pyrophosphates, carboxymethyloxy-succinates, polyacrylates, citrates or nitrilo-triacetates.

The present invention also envisages that the proportion of the oil component in the solid redispersible emulsion is at least 30% by weight, preference being given to proportions of >50% by weight and especially >75% by weight, based on the overall emulsion.

In addition to the solid redispersible emulsion itself, the present invention also encompasses a process for producing it. In this process, in process step a), the oil component is first emulsified in water, which can optionally be done in the presence of a suitable emulsifier. Subsequently, in process step b), the emulsion from process step a) is mixed with a solution of the shell material in water. Then, in process step c), the mixture obtained from process step b) is introduced into a solution which comprises the polyvalent metal ions.

Alternatively, it is also possible in process step a) to prepare a solution of the shell material in water, then, in process step b), to emulsify the oil component in the solution from process step a), optionally with addition of a suitable emulsifier, and finally, in process step c), to introduce the emulsion from process step b) into a precipitation solution comprising polyvalent metal ions.

Likewise possible is a process in which, in process step a), an emulsion of the oil component in water is prepared, optionally with addition of an emulsifier, in process step b), the shell material is dissolved in the emulsion from process step a), and, again, in process step c), the solution obtained in process step b) is introduced into the precipitation solution which comprises polyvalent metal ions.

In this way, the emulsion is encapsulated in a shell material which has been stabilized by incorporation of polyvalent metal ions and is insoluble in water.

In process step c), the precipitation solutions used are solutions of di- or trivalent metal salts in water or alcohol/water mixtures. Particularly suitable solutions are those of alkaline earth metal salts in water/isopropanol mixtures.

If process step a) is to be performed in the presence of an emulsifier, it is possible in accordance with the invention to employ polysaccharides which may optionally be chemically modified. Particularly suitable in this case are hydrocolloids.

A further advantage of the process according to the invention is found to be that the size of the particles can be varied over a relatively wide range through the suitable selection of the process used for dropwise addition to the precipitation solution. The dissolution rate can additionally also be controlled via the particle size. The generation of the droplets is not limited to a particular process, which is why suitable methods from the prior art, which include atomization by an airstream, excited jet decomposition by vibrational excitation or so-called jet-cutters, can be employed as suitable.

The particles thus obtained from process step c) can be removed from the precipitation solution by the known processes for solid/liquid separation. Representative examples here include filtration, which may optionally be performed with the aid of elevated or reduced pressure, but also sedimentation or centrifugation. Optionally, the solid removed can be washed before the drying, for which it is customary to use water, alcohols or suitable mixtures thereof. However, it is also possible to add substances which prevent conglutination of the particles to the wash solution. Examples of useful substances for this purpose are surface-active substances such as phospholipids, surfactants, polysorbates or the like, but also insoluble separating agents, for example silicas. For the drying of the product, it is possible to employ the customary processes and apparatuses, the prefered apparatuses being contact dryers or fluidized bed dryers, since the low mechanical stability of the resulting particles in the still-moist state should be taken account of in any case.

Finally, the present invention also encompasses the use of the solid redispersible emulsion in laundry care compositions. In this connection, it may be advantageous when these care compositions are combined with components which are capable of binding metal ions in a liquid environment. Mention should be made here especially of complexing agents such as polyphosphates, zeolites and other water softeners, which are customary constituents of washing powders anyway in most cases as so-called "builders". In this way, the release of the polyvalent metal ions stabilized in the shell material in an aqueous environment can be promoted. For wash liquors, this means that the components of a commercial powder detergent which has been mixed, for example, with the inventive solid redispersible emulsion contribute to the release of the polyvalent metal ions fixed in the shell of the solid emulsion, as a result of which the shell itself becomes water-soluble and the initially encapsulated emulsion component is thus released into the aqueous medium in a time- and medium-dependent manner. When the emulsion component is a fabric softener, it can display its desired action on the textile fiber there.

In summary, it can be stated that it becomes possible with the present invention to provide especially fabric softener emulsions, which have to date been available only as liquid formulations, now in solid powder form. In this way, the fabric softeners themselves can be stored, dosed and optionally formulated with powder detergents in an improved manner. In addition, the absence of the otherwise typically required inactive components allows the ecological balance to be improved significantly.

The examples which follow illustrate the advantages of the present invention.

EXAMPLES

Example 1

10 g of an amino-functional polydimethylsiloxane were emulsified in 90 ml of a 2% guar solution. The emulsion was admixed with the same volume of a 1% solution of sodium alginate in water. The mixture was subsequently added dropwise to a 0.1 M solution of $CaCl_2$ in 50% isopropanol, and the solidified gel spheres were removed by filtration and then dried in a fluidized bed dryer at 100° C. down to a residual moisture content of 2% by weight. The coarse powder obtained exhibited no change in distilled water over a period of several hours, but dissolved rapidly in 0.1 M EDTA solution with complete reformation of the emulsion.

Example 2

10 g of an orange oil were emulsified in 90 ml of a 2% gum arabic solution. The emulsion was admixed with the same volume of a 1% solution of sodium alginate in water. Subsequently, the mixture was added dropwise to a 0.1 M $CaCl_2$ solution, and the solidified gel spheres were removed by filtration and dried in a fluidized bed dryer at 60° C. down to a water content of 2% by weight. The resulting coarse powder is insoluble in water, but dissolves rapidly in 0.1 M EDTA solution, which forms a cloudy emulsion.

The invention claimed is:

1. A solid redispersible emulsion consisting of an oil-in-water emulsion of at least one laundry care component encapsulated in a shell of a shell material stabilized by polyvalent metal ions, wherein said shell is water-insoluble and becomes water-soluble through release of the metal ions.

2. The solid emulsion of claim 1, wherein the laundry care component is a fabric softener.

3. The solid emulsion of claim 1, wherein the shell material comprises at least one polysaccharide.

4. The solid emulsion of claim 3, wherein said polysaccharide is selected from the group consisting of: alginates, pectins and carrageenans.

5. The solid emulsion of claim 3, wherein said polysaccharide is selected from the group consisting of: alginic acid; sodium alginate; potassium alginate;

ammonium alginate; low-esterification pectin; low-amidation pectin; κ-carrageenan; and mixtures thereof.

6. The solid emulsion of claim 3, wherein said polysaccharide contains acid groups in free or salt form.

7. The solid emulsion of claim 3, wherein said polysaccharide is biodegradable.

8. The solid emulsion of claim 1, wherein the shell comprises at least one polyvalent metal ion selected from the group consisting of : $Ca^{2+}$; $Sr^{2+}$; $Ba^{2+}$;

$Al^{3+}$; $Cu^{2+}$; and $Zn^{2+}$.

9. The solid emulsion of claim 1, wherein the laundry care component makes up at least 30% by weight of said solid redispersible emulsion.

10. The solid emulsion of claim 1, wherein the laundry care component makes up more than 50% by weight of said solid redispersible emulsion.

11. A laundry care composition, comprising the solid redispersible emulsion of claim 1.

12. The laundry care composition of claim 11, further comprising a component that binds metal ions.

13. The laundry care composition of claim 12, wherein said component which binds metal ions is selected from the group consisting of: zeolites;

EDTA and salts thereof; polyphosphates; pyrophosphates; carboxymethyloxysuccinates;

polyacrylates; citrates; and triacetates.

14. The laundry care composition of claim 11, wherein said laundry care composition is a powder detergent.

15. A process for making the solid redispersible emulsion of claim 1, comprising the steps of:

a) emulsifying a laundry care component in water to produce an emulsion;

b) mixing the emulsion of step a) with a solution of a shell material in water or dissolving a shell material in the emulsion of step a), to provide a mixture; and c) introducing the mixture of step b) into a solution comprising polyvalent metal ions.

16. The process of claim 15, wherein an emulsifier is present in step a).

17. The process of claim 15, wherein the solution in step c) is a solution comprising a divalent or trivalent metal salt in water or an alcohol/water mixture.

18. The process of claim 17, wherein said solution is a solution of calcium chloride in a water/isopropanol mixture.

19. A process for making the solid redispersible emulsion of claim 1, comprising the steps of:

a) dissolving a shell material in water to produce a solution;

b) emulsifying a laundry care component in the solution of step a) to produce an emulsion; and c) introducing the emulsion of step b) into a solution comprising polyvalent metal ions.

20. The process of claim 19, wherein an emulsifier is present in step b).

21. The process of claim 19; wherein the solution in step c) is a solution comprising a divalent or trivalent metal salt in water or an alcohol/water mixture.

22. The process of claim 21, wherein said solution is a solution of calcium chloride in a water/isopropanol mixture.

* * * * *